US005152220A

United States Patent [19]

Lindner et al.

[11] Patent Number: 5,152,220

[45] Date of Patent: Oct. 6, 1992

[54] WIPING DEVICE FOR THE PLATE CYLINDER OF AN INTAGLIO PRINTING MACHINE

[75] Inventors: Georg J. Lindner, Veitshoechheim; Johannes G. Shaede; Hans J. Zelfel, both of Wuerzburg, all of Fed. Rep. of Germany

[73] Assignee: De La Rue Giori S.A., Lausanne, Switzerland

[21] Appl. No.: 734,259

[22] Filed: Jul. 22, 1991

[30] Foreign Application Priority Data

Aug. 17, 1990 [CH] Switzerland ..... 2682/90

[51] Int. Cl.[5] ..... B41F 9/08

[52] U.S. Cl. ..... 101/155; 101/167; 101/423; 101/425

[58] Field of Search ..... 101/155, 167, 423, 425

[56] References Cited

U.S. PATENT DOCUMENTS 2,617,356 11/1952 Meyer ..... 101/216
3,150,002 9/1964 Justus ..... 101/425
3,486,444 12/1969 Huck ..... 101/155
3,762,319 10/1973 Gazzola et al. ..... 101/155
4,899,654 2/1990 Hoshi et al. ..... 101/167

*Primary Examiner*—Edgar S. Burr
*Assistant Examiner*—Anthony H. Nguyen
*Attorney, Agent, or Firm*—Kane, Dalsimer, Sullivan, Kurucz, Levy, Eisele and Richard

[57] ABSTRACT

The wiping device has a trough (4) and a wiping cylinder (2) which is mounted in the mutually opposite side walls (4a) of the trough (4). The trough (4) is itself mounted tiltably about a pivot axis (6) lying at least approximately in that plane (T') which passes through the axis of rotation of the wiping cylinder and which is parallel to the tangential plane (T) of the wiping cylinder (2) and plate cylinder (1) passing through the point of contact between the two cylinders. The pressing force with which the wiping cylinder (2) bears against the plate cylinder (1) can be set and requlated during the printing operation by means of an adjusting device (11, 12, 13) by correspondingly tilting the trough (4) together with the wiping cylinder (2) about its pivot axis (6). At the same time, the pressing forces are transmitted by adjusting rods (7) which are mounted on both sides of the wiping cylinder (2) and which act on the trough (4).

11 Claims, 2 Drawing Sheets

WIPING DEVICE FOR THE PLATE CYLINDER OF AN INTAGLIO PRINTING MACHINE

FIELD OF THE INVENTION

The invention relates to a wiping device for the plate cylinder of an intaglio printing machine, with a trough for receiving the cleaning fluid and mechanical cleaning elements and with a wiping cylinder which is mounted rotatably in mutually opposite side walls of the trough and which can be pressed with adjustable pressure against the plate cylinder.

PRIOR ART

Wiping devices of this type have been known for example from the EP-A-357825 and serve for clearing the inked surface of the intaglio printing plates completely of any ink before the printing and at the same time for simultaneously filling the engraved cuts with ink perfectly. To make it possible to adjust the pressing force with which the wiping cylinder bears against the plate cylinder, the wiping cylinders have been mounted in eccentric bearings, so that by adjusting the eccentric bearing parts the distance between the wiping cylinder and the plate cylinder and therefore the pressing force of the wiping cylinder can be adjusted. This eccentric mounting has various disadvantages:

The adjustment has to be made by hand on both sides of the wiping cylinder, this being laborious.

A direct measurement of the pressing force is virtually impossible; consequently, the pressing force has hitherto generally been determined only indirectly, during operation, from the current consumption or power requirement of the electric motor driving the wiping cylinder, this being inaccurate because the measurement involves frictional losses, especially the friction of the eccentric bearings. The disadvantage of the wiping devices known hitherto is therefore that only a very rough setting of the pressing force is possible owing to the lack of a direct pressure measurement which could also be carried out with the printing machine at a standstill.

Furthermore, only wiping cylinders with narrow diametral tolerances can be inserted into the eccentric bearings.

Finally, during an adjustment of the eccentric bearing, the geometrical arrangement of the cleaning elements in relation to the wiping cylinder is changed.

As constant a pressing force of the wiping cylinder as possible during the operation of the printing machine is essential for perfect wiping. This pressing force can change during operation as a result of the operating conditions which do not remain constant, especially due to the heating of the printing plates and of the wiping cylinder and to the wear of the surface of the wiping cylinder. To readjust the pressing force after a specific operating time, the eccentric bearings have to be adjusted as synchronously as possible on both sides by hand, this being almost impossible in practice and therefore resulting in inadequate wiping during the adjustment and consequently rejection.

SUMMARY OF THE INVENTION

The object on which the invention is based is to provide a wiping device, in which the pressing force with which the wiping cylinder bears against the plate cylinder can be adjusted more accurately and more easily than hitherto, especially during the printing operation, and which in a simple way allows a continuous direct measurement of the pressing force and consequently a pressure regulation, the frictional forces between the wiping cylinder and plate cylinder impairing the pressure measurement, if possible, not at all or only insignificantly.

This object is achieved, according to the invention, by means of the features indicated in claim 1. These ensure, with the drive torque of the wiping cylinder taken into account, that the generally variable frictional forces between the wiping cylinder and plate cylinder influence the pressure measurement only insignificantly or not at all. Moreover, the effective direction of the force exerted by the adjusting device is expediently at least approximately perpendicular to the connecting line between the pivot axis of the trough and the point of engagement of the adjusting device.

The design according to the invention of the wiping device has the further advantage that the wiping cylinder can be mounted concentrically, preferably in pendulum bearings, with eccentric bearings being avoided, and that the tiltable trough together with the wiping cylinder can be adjusted directly in a simple way, even during operation, to keep the pressing force constant, the force exerted by the adjusting device being directly measurable by means of a dynamometer.

According to a preferred embodiment, the trough is mounted by means of a pendulum bearing and is equipped on both sides of this pendulum bearing with supporting rollers which are supported in a freely rollable manner on plane bearing faces oriented at least approximately perpendicularly to said tangential plane, the axes of these supporting rollers being aligned with one another and, together with the pendulum bearing, defining said pivot axis, and moreover the trough being tiltable about a second pivot axis perpendicular to this pivot axis and intersecting the axis of rotation of the wiping cylinder.

Preferably, a regulation of the pressing force can be carried out with the wiping device according to the invention in that a dynamometer measuring the actual value of the pressing force is provided and the adjusting device constitutes, together with this dynamometer, a pressure-regulating system which keeps the pressing force of the wiping cylinder constant at a predeterminable desired value during operation.

Further expedient embodiments of the wiping device according to the invention emerge from the dependent claims.

BRIEF DESCRIPTION OF THE DRAWINGS

The invention is explained in more detail by means of an exemplary embodiment with reference to the drawing. In this.

DESCRIPTION OF THE PREFERRED EMBODIMENT

Figure 1:
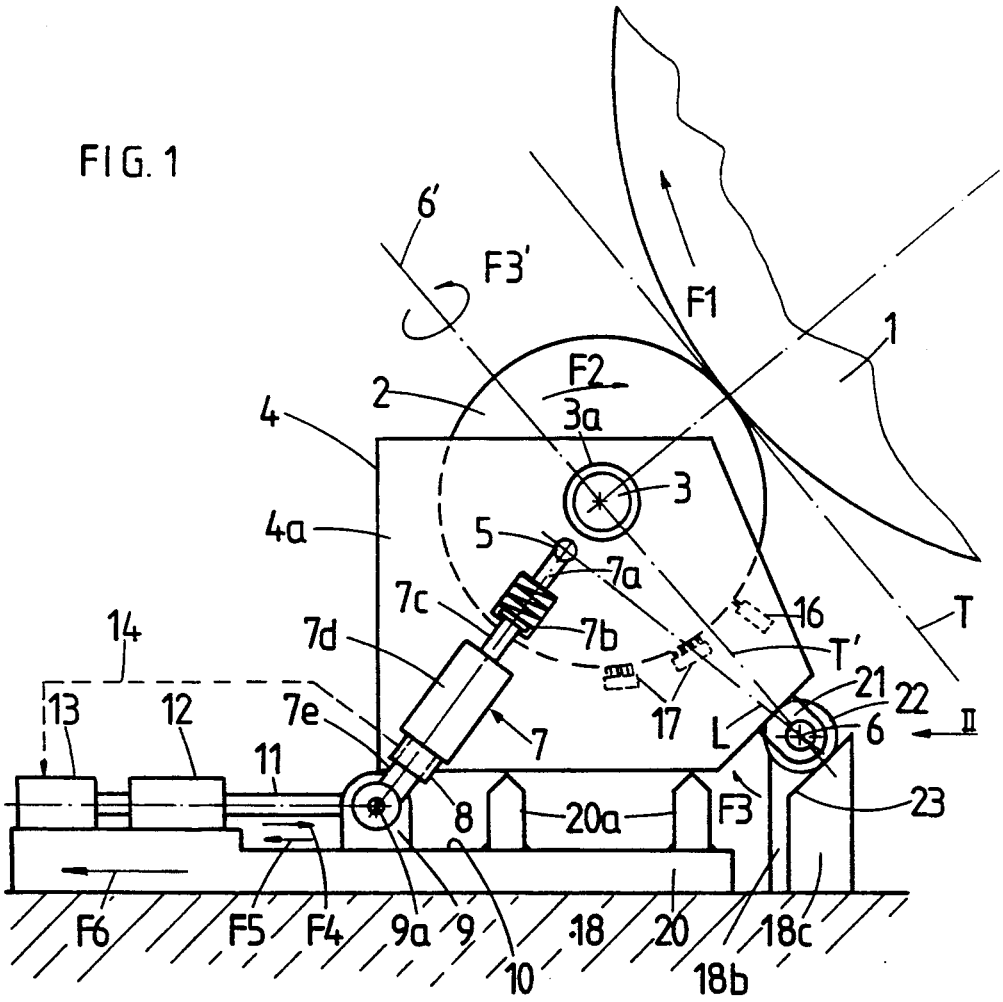
FIG. 1 shows a diagrammatic side view of a wiping device according to the invention.
Figure 2:
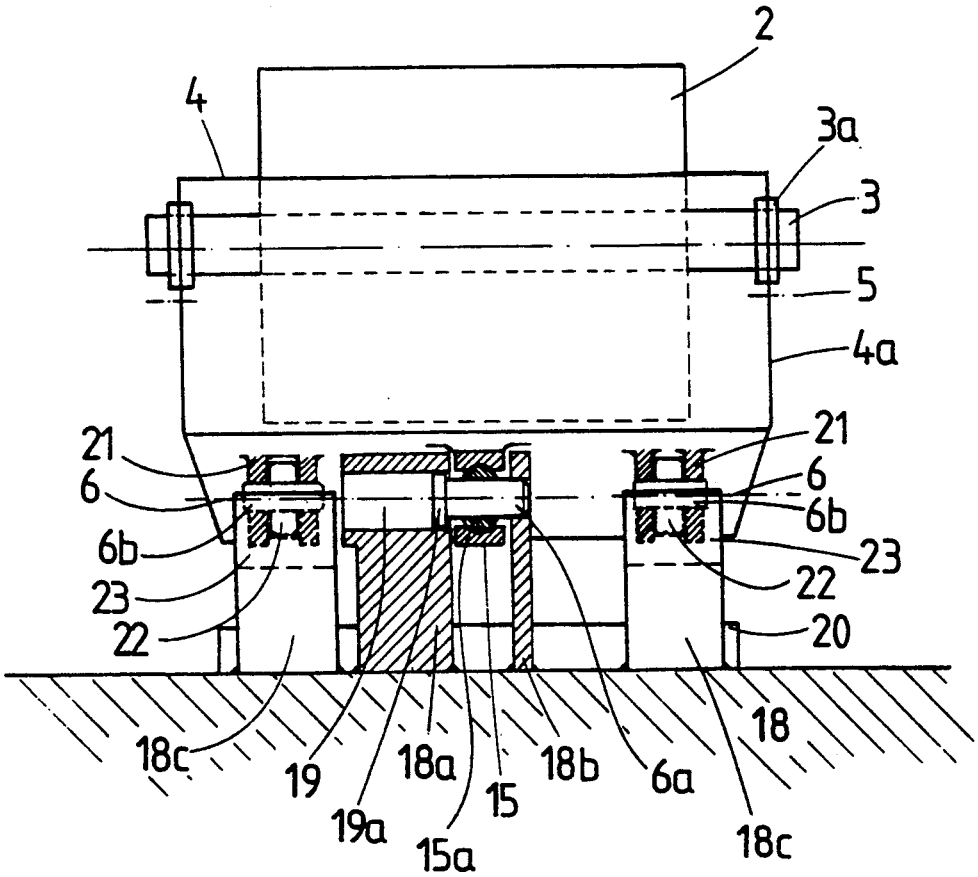
FIG. 2 shows a diagrammatic view of the rear side of the trough in the direction of the arrow II according to FIG. 1, with bearing parts for the pivot axis which are represented in section.

According to FIGS. 1 and 2, the plate cylinder 1 of an intaglio printing machine not shown in any more detail interacts with the wiping cylinder 2 of the wiping device. The wiping cylinder 2 dips partially into a trough 4 filled with a cleaning fluid and is mounted concentrically by means of its journals 3 in bearings 3*a* which are mounted in the mutually opposite side walls 4*a* of the trough 4. The bearings 3*a* are preferably pendulum bearings with plain bearings. The pendulum bearings prevent the plain bearings from tilting and allow compensation in the event of an inclination of the journals 3 as a result of a flexion of the wiping cylinder 2. Furthermore, also arranged in this trough 4 are conventional cleaning elements, shown diagrammatically, in the form of doctors 16 and brushes 17 which bear against the surface of the wiping cylinder and which clear ink from this. The plate cylinder 1 and wiping cylinder 2 have the same direction of rotation F1 and F2, that is to say mutually opposed circumferential speeds at the point of contact.

In the example under consideration, the trough 4 is installed on a carriage 20 which is displaceable on a stand 18 of the printing machine between a working position, shown in FIG. 1, in which the wiping cylinder 2 bears against the plate cylinder 1 and an inoperative position in which the wiping cylinder 2 is moved off from the plate cylinder 1. Carrier parts 20*a* fastened to the carriage 20 serve for supporting the bottom of the trough 4 when this is moved off. The displaceability of the carriage 20 will be dealt with again later.

In the working position of the wiping cylinder 2, the trough 4 is mounted tiltably about a pivot axis 6 lying in the lower region of the rear side of the trough. This pivot axis 6 is arranged in that plane T' passing through the axis of rotation of the wiping cylinder and parallel to the tangential plane T passing through the point of contact between the wiping cylinder 2 and plate cylinder 1; at the same time, the direction of movement of the circumference of the wiping cylinder at the point of contact, as indicated by the direction of rotation F2, points downwards, that is to say approximately to the pivot axis 6.

In the example under consideration, for mounting the wiping cylinder 2 there is a bearing 15 designed as a pendulum bearing and having a journal 6*a* arranged in the bearing orifice 15*a* and two supporting rollers 22 which are provided on both sides of this bearing 15 on the trough 4 and which are supported in a freely rollable manner on oblique bearing faces 23. The bearing 15 projects on the rear side of the trough 4 and, as shown in FIG. 2, extends only in the central region of the trough 4. In the working position of the wiping cylinder 2, the journal 6*a* is mounted in stays 18*a*, 18*b* which are fastened to the stand 18. The two supporting rollers 22 are mounted by means of their journals 6*b* in projections 21 which are fastened to the trough 4. The bearing faces 23 are formed by oblique faces of two stays 18*c* fastened to the stand 18. The axes of the journals 6*b* of the two supporting rollers 22 and the axis of the journal 6*a* of the bearing 15 are aligned with one another and define the pivot axis 6. The inclination of the bearing faces 23 which lie in a common plane is selected so that they are oriented at least approximately perpendicularly to said plane T', that is to say also perpendicularly to the tangential plane T. The mounting described ensures that the trough 4 is tiltable not only about said pivot axis 6 in the direction of the arrow F3 according to FIG. 1, but also in the direction of the arrow F3' about a pivot axis 6' which is perpendicular to the first-mentioned pivot axis 6 and which intersects the axis of rotation of the wiping cylinder. The oblique bearing faces 23 and the bearing 15 with its spherical bearing part thus define a pivoting movement with two degrees of rotational freedom about the pivot axes F3 and F3', thereby guaranteeing that the wiping cylinder 2 is pressed uniformly against the plate cylinder 1 over the entire cylinder length.

The bearing faces 23 of the supporting rollers 22 could also be fastened to the carriage 20, but the fastening to the stand 18 is more advantageous in order to achieve increased rigidity.

On each side of the wiping cylinder 2, an adjusting rod designated as a whole by 7 is articulated on the trough 4 underneath the bearing 3*a* by means of a journal 5. The other end of this adjusting rod 7 is articulated by means of a journal 9*a* on a sliding piece 9 which can be pushed to and fro in the direction of the arrows F4, F5 on a horizonal plane abutment 10 formed by the surface of the carriage 20, that is to say the direction of displacement is parallel to a plane perpendicular to the axis 3 of the wiping cylinder. At the same time, the adjusting rod 7 forms an acute angle with the bearing face of the abutment 10. For generating the pressing force there is an adjusting device which acts on the sliding piece 9 and which, in the exemplary embodiment under consideration, consists of an actuating drive 13 in the form of an electric servomotor and of an adjusting gear 12 driven by this and having an adjusting spindle which is displaceable in the longitudinal direction and which is fastened to the sliding piece 9. The adjusting gear 12 can contain particularly a worm gear.

The adjusting rods 7 can, in principle, be rigid one-part arms. During the displacement of the sliding piece 9 by the adjusting device in the direction of the arrow F4, the wiping cylinder 2 is pressed more firmly against the plate cylinder by the adjusting rods 7, the trough 4 tilting upwards about its pivot axis 6 in the direction of the curved arrow F3. More specifically, the movement of the trough 4 by means of the adjusting rods 7 is a superposition of two pivoting movements about the pivot axes 6 and 6'. During the displacement of the sliding piece 9 the opposite way in the direction of the arrow F5, the pressing force is reduced. Since the trough 4 as a whole is adjusted, the cleaning elements 16, 17 of course always have the same geometrical position in relation to the wiping cylinder 2.

The arrangement can, for example, be such that, starting from an initial position of the wiping cylinder 2 in which it presses with a specific force against the plate cylinder 1, the range of adjustment of the sliding piece 9 is between −7.0 mm (in the direction of a reduction of the pressing force) and +5.6 mm (in the direction of an increase of the pressing force), and the corresponding range of adjustment of the wiping cylinder is between approximately −2.0 mm and +1.5 mm. The ratio of the ranges of adjustment of the wiping cylinder 2 and of the sliding piece 9 therefore corresponds to a step-down of the adjustment and naturally depends on the angle between the longitudinal axis of the adjusting rods 7 and the bearing face of the abutment 10. A change of the pressing force can be made directly during the printing operation.

In the example according to FIG. 1, the effective direction of the force exerted by the adjusting rods 7 is approximately perpendicular to the connecting line L between the pivot axis 6 and the point of application of this force, that is to say the journal 5.

Preferably, when the printing machine is in operation, the pressing force of the wiping cylinder 2 is maintained at a predetermined constant value. Installed for this purpose on each adjusting rod 7 is a dynamometer 8 which belongs as an actual-value transmitter to a pressure-regulating system and which continuously indicates the actual value of the pressing force. The dynamometer can be, for example, a load cell with strain gages, the deformation being converted into the detuning of a Wheatstone bridge and this detuning being measured by a measuring amplifier.

The advantage of the above-described geometrical arrangement of the pivot axis 6 in relation to the axis of rotation 3 of the wiping cylinder is that the frictional forces between the wiping cylinder 2 and plate cylinder 1 are involved in the measurement of the pressing force hardly at all or only insignificantly.

The actuating drive 13 is controlled as a function of the difference between this actual value and the predetermined desired value of the pressing force. This situation is illustrated diagrammatically in FIG. 1 by a line 14 leading from the dynamometer 8 to the actuating drive 13.

In the preferred embodiment according to FIG. 1, part of the adjusting rod 7 consists of a hydraulic cylinder 7*d*, to which is fastened an arm 7*e* articulated on the sliding piece 9 and carrying the dynamometer 8. The piston rod 7*c* of the piston of this hydraulic cylinder 7*d* bears against one end of a compression spring 7*b*, the other end of which acts on an arm 7*a* articulated on the journal 5. The hydraulic cylinder 7*d* constitutes a virtually rigid portion of the adjusting rod 7 and, in the working position of the wiping cylinder 2, is subjected to a predetermined pressure which can amount, for example, to 100 bars. By means of this hydraulic cylinder 7*d*, therefore, the pressing force can be given a rough setting, whilst the fine setting or pressure regulation is carried out by the displacement of the sliding piece 9, as described above. The hydraulic cylinder 7*d* serves at the same time for the application and release of the wiping cylinder.

The compression springs 7*b* cause the wiping cylinder 2 to bear resiliently against the plate cylinder 1. The compression springs 7*b* can also be omitted, in which case the piston rod of the hydraulic cylinder 7*d* is articulated directly on the trough 4.

The advantage of the above-described arrangement of the adjusting rod 7, sliding piece 9 and adjusting device 11, 12, 13 is that the adjusting device does not constantly have to absorb the high pressing force of the wiping cylinder 2, but on the contrary the wiping cylinder 2 is supported on the abutment 10 via the adjusting rods 7 and sliding pieces 9.

In the example under consideration, when not in operation the wiping cylinder 2 can be moved off from the plate cylinder 1. For this purpose, the trough 4, together with the sliding pieces 9, abutment 10 and adjusting devices 11, 12, 13, rests on the displaceable carriage 20, and the journal 6*a* is mounted longitudinally displaceably in the stays 18*a*, 18*b* of the stand 18 and is adjustable so that it can be pulled out of the bearing 15 for the release of the trough 4. As shown diagrammatically in FIG. 2, this purpose is served by an adjusting cylinder 19 which is installed in the stay 18*a* and to the piston 19*a* of which the journal 6*a* is fastened. With the piston 19*a* extended, the journal 6*a* is maintained in the working position shown, and with the piston retracted it is maintained in the drawn-back position of rest, in which the journal 6*a* is removed from the orifice 15*a* of the bearing 15. In this position of rest, as a result of the displacement of the carriage 20 in the stand 18 in the direction of the arrow F6, the trough 4 can be moved out of the working position shown in FIG. 1 into an inoperative position moved off from the plate cylinder 1 and back into its working position again. During this time, as soon as the supporting rollers 22 have lifted off from the bearing faces 23, the trough 4 is carried by the carrier parts 20*a* of the carriage 20. After the trough 4 has resumed its working position in which it is supported on the bearing faces 23 by means of the supporting rollers 22, the journal 6*a* is pushed by the adjusting cylinder 19 into the bearing 15 and into the bearing orifice of the stay 18*b*, so that the above-described tiltability of the trough 4 is guaranteed.

The invention is not restricted to the exemplary embodiments described, but permits of many alternative versions in respect of the design of the trough and its mounting, the adjusting rods and the adjusting device.

We claim:

1. A wiping device for the plate cylinder (1) of an intaglio printing machine, with a trough (4) for receiving the cleaning fluid and mechanical cleaning elements and with a wiping cylinder (2) which is mounted rotatably in mutually opposite side walls (4*a*) of the trough (4) and which can be pressed with adjustable pressure against the plate cylinder (1), an adjusting device (11, 12, 13), wherein the trough (4) is mounted tiltably about a pivot axis (6) and, together with the wiping cylinder (2), is subjected to the effect of said adjusting device (11, 12, 13) which presses it with adjustable force about the pivot axis (6) in the direction of the plate cylinder (1), and wherein this pivot axis (6) lies at least approximately in that plate (T') which passes through the axis of rotation (3) of the wiping cylinder and which is parallel to the tangential plane (T) of the wiping cylinder (2) and plate cylinder (1) passing through the point of contact between these two cylinders, the direction of rotation of the circumference of the wiping cylinder at the point of contact pointing approximately to the said pivot axis (6), wherein the trough (4) is mounted in pendulum bearing (15), said trough being provided with supporting rollers on both sides of said pendulum bearing, said supporting rollers being supported in a freely rollable manner on plane bearing faces(23) oriented at least approximately perpendicularly to said tangential plane (T), the axes of said supporting rollers (22) being aligned with one another and, together with the pendulum bearing (15), defining said pivot axis (6), a second pivot axis (6') perpendicular to said pivot axis (6) and intersecting the axis of rotation of the wiping cylinder, and means mounting said trough for tilting movement about said second pivot axis.

2. The wiping device as claimed in claim 1, wherein the effective direction of the force exerted by the adjusting device (11, 12, 13) is at least approximately perpendicular to the connecting line (L) between the pivot axis (6) of the trough (4) and the engagement point (5) of the adjusting device.

3. The wiping device as claimed in claim 2, wherein the force exerted by the adjusting device (11, 12, 13) is transmitted by adjusting rods (7) which are mounted on both sides of the wiping cylinder (2) and which act on the trough (4).

4. The wiping device as claimed in claim 3, wherein the adjusting device comprises an adjusting gear (12) moving the adjusting rods (7) and an actuating drive (13) driving this adjusting gear.

5. A wiping device for the plate cylinder (1) of an intaglio printing machine, with a trough (4) for receiving the cleaning fluid and mechanical cleaning elements and with a wiping cylinder (2) which is mounted rotatably in mutually opposite side walls (4*a*) of the trough (4) and which can be pressed with adjustable pressure against the plate cylinder (1), an adjusting device (11, 12, 13), wherein the trough (4) is mounted tiltably about a pivot axis (6) and, together with the wiping cylinder (2), is subjected to the effect of said adjusting device (11, 12, 13) which presses it with adjustable force about the pivot axis (6) in the direction of the plate cylinder (1), and wherein this pivot axis (6) lies at least approximately in that plane (T') which passes through the axis of rotation (3) of the wiping cylinder and which is parallel to the tangential plane (T) of the wiping cylinder (2) and plate cylinder (1) passing through the point of contact between these two cylinders, the direction of rotation of the circumference of the wiping cylinder at the point of contact pointing approximately to the said pivot axis (6), wherein the effective direction of the force exerted by the adjusting device (11, 12, 13) is at least approximately perpendicular to the connecting line (L) between the pivot axis (6) of the trough (4) and the engagement point (5) of the adjusting device, wherein the force exerted by the adjusting device (11, 12, 13) is transmitted by adjusting rods (7) which are mounted on both sides of the wiping cylinder (2) and which act on the trough (4), wherein the adjusting device comprises an adjusting gear (12) moving the adjusting rods (7) and an actuating drive (13) driving this adjusting gear, wherein the end of each adjusting rod (7) facing away from the wiping cylinder (2) is articulated on a sliding piece (9) supported on an abutment (10), the bearing face of which forms an acute angle with the longitudinal axis of the adjusting rod (7), and wherein this sliding piece (9) is displaceable on this bearing face by an adjusting spindle (11) in parallel with a plane perpendicular to the axis of the wiping cylinder.

6. The wiping device as claimed in claim 5, wherein part of each of the adjusting rods (7) comprises a hydraulic cylinder (7*d*) which can be subjected to a predeterminable constant pressure.

7. The wiping device as claimed in claim 1, further including compression springs (7*b*) whereby the forces exerted on the wiping cylinder (2) by the adjusting device (11, 12, 13) are transmitted.

8. A wiping device for the plate cylinder (1) of an intaglio printing machine, with a trough (4) for receiving the cleaning fluid and mechanical cleaning elements and with a wiping cylinder (2) which is mounted rotatably in mutually opposite side walls (4*a*) of the trough (4) and which can be pressed with adjustable pressure against the plate cylinder (1), an adjusting device (11, 12, 12), wherein the trough (4) is mounted tiltably about a pivot axis (6) and, together with the wiping cylinder (2), is subjected to the effect of said adjusting device (11, 12, 13) which presses it with adjustable force about the pivot axis (6) in the direction of the plate cylinder (1), and wherein this pivot axis (6) lies at least approximately in that plane (T') which passes through the axis of rotation (3) of the wiping cylinder and which is parallel to the tangential plane (T) of the wiping cylinder (2) and plate cylinder (1) passing through the point of contact between these two cylinders, the direction of rotation of the circumference of the wiping cylinder at the point of contact pointing approximately to the said pivot axis (6), including at least one dynamometer (8) for measuring the actual value of the pressing force of the wiping cylinder (2), and said adjusting device (11, 12, 13) forming, together with the dynamometer (8), a pressure-regulating system which keeps the pressing force of the wiping cylinder (2) constant at a predeterminable desired value during operation.

9. The wiping device as claimed in claim 8, wherein dynamometers (8) are attached to each of the adjusting rods (7).

10. A wiping device for the plate cylinder (1) of an intaglio printing machine, with a trough (4) for receiving the cleaning fluid and mechanical cleaning elements and with a wiping cylinder (2) which is mounted rotatably in mutually opposite side walls (4*a*) of the trough (4) and which can be pressed with adjustable pressure against the plate cylinder (1), an adjusting device (11, 12, 13), wherein the trough (4) is mounted tiltably about a pivot axis (6) and, together with the wiping cylinder (2), is subjected to the effect of said adjusting device (11, 12, 13) which presses it with adjustable force about the pivot axis (6) in the direction of the plate cylinder (1), and wherein this pivot axis (6) lies at least approximately in the plate (T') which passes through the axis of rotation (3) of the wiping cylinder and which is parallel to the tangential plane (T) of the wiping cylinder (2) and plate cylinder (1) passing through the point of contact between these two cylinders, the direction of rotation of the circumference of the wiping cylinder at the point of contact pointing approximately to and said pivot axis (6), wherein the trough (4) is mounted in its central region by means of a pendulum bearing (15), projecting on its rear side, on a journal (6*a*) forming the pivot axis (6), and this journal is mounted on the stand (18) of the printing machine displaceably in the longitudinal direction and is adjustable between a working position engaging into the orifice (15*a*) of the bearing (15) and a position of rest releasing the bearing (15) and trough (4), and wherein the trough (4), together with the adjusting device (11, 12, 12), is mounted in said stand (18) so as to be movable off from the plate cylinder (1), said journal (6*a*) being pushed into said bearing (15) after the displacement of the trough (4) out of its moved-off position into its working position.

11. The wiping device as claimed in claim 4, wherein the actuating drive (13) comprises a servomotor driving a worm gear.

* * * * *